US010132479B2

(12) United States Patent
Wu et al.

(10) Patent No.: US 10,132,479 B2
(45) Date of Patent: Nov. 20, 2018

(54) FLIPPING INSTALLATION DEVICE FOR LED STRIP LIGHTING

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Xufeng Wu, Zhejiang (CN); Wanjiong Lin, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/629,712

(22) Filed: Jun. 21, 2017

(65) Prior Publication Data

US 2017/0370563 A1 Dec. 28, 2017

(30) Foreign Application Priority Data

Jun. 22, 2016 (CN) ..... 2016 1 0459966

(51) Int. Cl.

| | |
|---|---|
| ***F21S 4/28*** | (2016.01) |
| ***F21S 8/02*** | (2006.01) |
| ***F21V 17/16*** | (2006.01) |
| ***F21V 21/02*** | (2006.01) |
| ***F21V 21/04*** | (2006.01) |
| ***F21V 21/14*** | (2006.01) |

(Continued)

(52) U.S. Cl.

CPC ..... *F21V 21/14* (2013.01); *F21S 4/28* (2016.01); *F21S 8/026* (2013.01); *F21V 17/164* (2013.01); *F21V 21/025* (2013.01); *F21V 21/04* (2013.01); *F21V 21/049* (2013.01); *F21V 21/088* (2013.01); *F21V 29/89* (2015.01); *F21Y 2103/10* (2016.08); *F21Y 2115/10* (2016.08)

(58) Field of Classification Search

CPC ..... F21V 21/14; F21V 21/025; F21V 21/04; F21V 21/048; F21V 21/088; F21V 29/89; F21V 17/164; F21S 4/28; F21S 8/026; F21Y 2103/10; F21Y 2115/10

See application file for complete search history.

(56) References Cited

U.S. PATENT DOCUMENTS

| | | | | |
|---|---|---|---|---|
| 9,568,172 | B1 * | 2/2017 | Chantos | F21V 21/14 |
| 2006/0141851 | A1 * | 6/2006 | Matsui | F21K 9/00 439/490 |

(Continued)

FOREIGN PATENT DOCUMENTS

| | | | | |
|---|---|---|---|---|
| WO | WO 2016006887 | A1 * | 1/2016 | F21V 33/00 |

*Primary Examiner* — Mary Ellen Bowman
(74) *Attorney, Agent, or Firm* — Wang Law Firm, Inc.

(57) ABSTRACT

A flipping installation device for LED strip lighting includes an installation frame, a house, at least one link mechanism, and at least one clamping mechanism. Each of the at least one link mechanism includes a first link mounted on the installation frame, a second link disposed on the house, and a third link rotatably connected between the first and second links. The first and second and third links is perpendicular to each other in the cross section perpendicular to the axial direction of the house when the house has been installed into the installation frame. Each of the at least one clamping mechanism includes a catch head disposed on the installation frame, and a resilient lock disposed on the house and coupled to the catch head. The link mechanism and the clamping mechanism are located on the opposite side of the house.

8 Claims, 2 Drawing Sheets

(51) Int. Cl.

| | |
|---|---|
| ***F21V 29/89*** | (2015.01) |
| ***F21V 21/088*** | (2006.01) |
| ***F21Y 103/10*** | (2016.01) |
| ***F21Y 115/10*** | (2016.01) |

(56) References Cited

U.S. PATENT DOCUMENTS

| | | | | |
|---|---|---|---|---|
| 2008/0137347 | A1* | 6/2008 | Trott | F21S 8/02 362/311.06 |
| 2009/0185359 | A1* | 7/2009 | Martinez | F21L 4/08 362/20 |
| 2017/0114990 | A1* | 4/2017 | Chae | F21V 21/15 |
| 2017/0284616 | A1* | 10/2017 | Coakley | F21S 8/026 |

* cited by examiner

FLIPPING INSTALLATION DEVICE FOR LED STRIP LIGHTING

RELATED APPLICATION

This present application claims benefit of the Chinese Application, CN 201610459966.0, filed on Jun. 22, 2016.

BACKGROUND

1. Technical Field

The present application relates to a lighting power supply device, and more particularly to a flipping installation device for LED strip lighting.

2. Description of the Related Art

Light emitting diode (LED) is growing in popularity due to decreasing costs and long life compared to incandescent lighting and fluorescent lighting. Recently, a number of LED lighting apparatuses have been designed to replace the halogen apparatus, as well as other traditional incandescent or fluorescence lighting apparatuses. In some places such as exhibition halls, jewelry stores, museums, supermarkets, and some home lighting, such as large villas, will use a lot of LED strip lamps. Moreover, in addition to lighting equipments, such as general traffic lights, billboards, motor-lights, etc., also use light-emitting diodes as light source. As described above, for the light-emitting diodes as a light source, the advantage is power saving, and the greater brightness. Therefore, the use has been gradually common.

As the LED strip lights is more and more used on the ceiling of the home or business, the beautiful installation of the LED strip lights is also getting higher and higher on the basis of the perfect light. Now, the LED strip lights are generally suspended in the ceiling or closed to the ceiling when it is used to the ceiling. Therefore, these installation methods of the LED strip lamps are not able to make the ceiling smooth. Especially for some of the floor of office which is not high enough, these installation methods will further cause the floor become lower and no beautiful.

Therefore, it is necessary to provide a flipping installation device for LED strip lighting which makes it possible to solve the above problems.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

The present application is illustrated by way of example and not by way of limitation in the figures of the accompanying drawings. It should be noted that references to "an" or "one" embodiment in this application are not necessarily to the same embodiment, and such references mean at least one.

Figure 1:
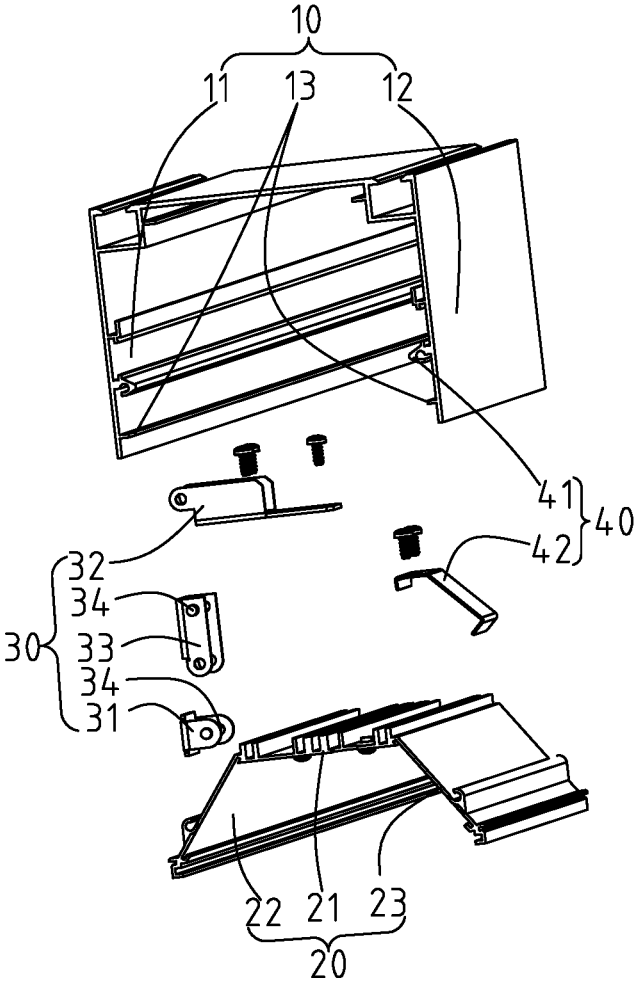
FIG. 1 is an explored view of a flipping installation device for LED strip lighting according to an embodiment.
Figure 2:
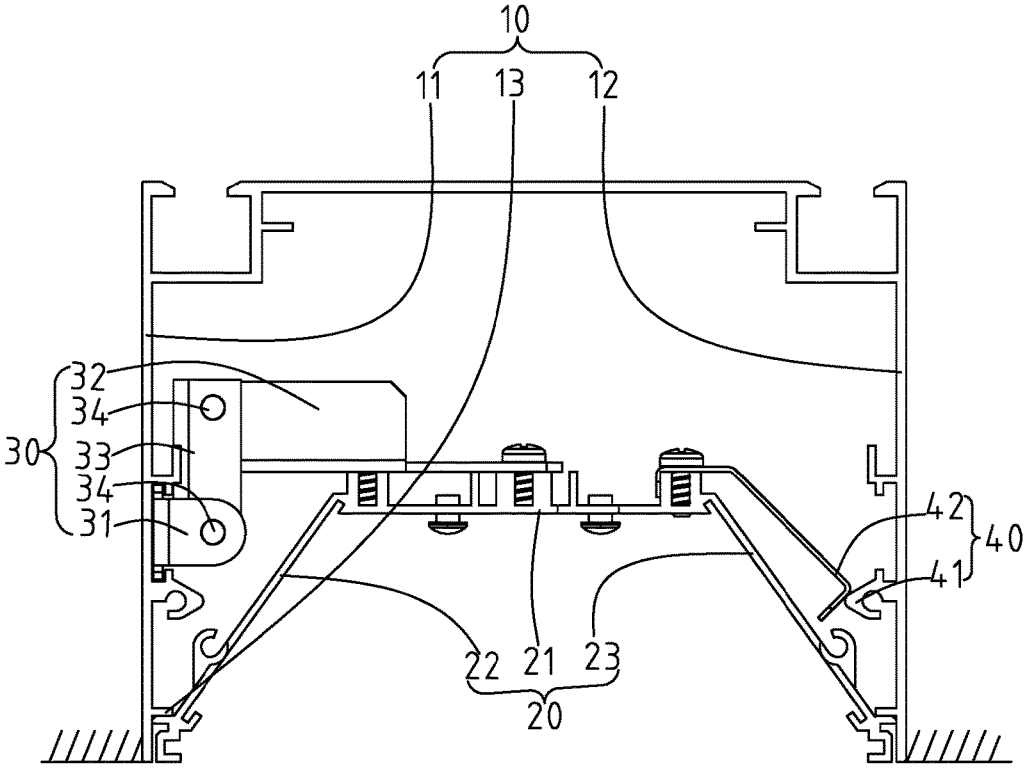
FIG. 2 is a cross sectional view of the flipping installation device for LED strip lighting of FIG. 1.

Referring to FIG. 1 to FIG. 2, a flipping installation device 100 for LED strip lighting is shown. The flipping installation device 100 for LED strip lighting includes an installation frame 10, a house 20 receiving in the installation frame 10, a link mechanism 30 disposed in one of two jointing edges between the installation frame 10 and the house 20, and a clamping mechanism 40 disposed in the other of two jointing edges between the installation frame 10 and the house 20. It may be understood that the LED strip lighting further includes other components, such as cover, end cap, wires, and so on, which is well known for these skilled in the art and not described in detail.

The installation frame 10 may be embedded into a ceiling and may be a square slot or other shape, such as an arc, a semicircle, or the like. In the present embodiment, the installation frame 10 is a square slot and includes a first free edge 11 and a second free edge 12. The installation frame 10 may be made of metal material for heat dissipation. Two stop bars 13 are respectively provided on the first and second free edges 11, 12. The stop bars 13 is configured to limit the depth of the house 20 into the installation frame 10 when the house 20 is rotated into the slot of the installation frame 10.

The house 20 is configured for mounting the cover, light module, or the like, and has a strip-typed structure and has a trapezoidal frame on the cross section perpendicular to an axial direction of the house 20. The house 20 includes an upper base 21, a bottom base (not labeled), a first side wall 22, and a second side wall 23. The first side wall 22 and the second side wall 23 are opposed to each other on both sides of the upper base 21. When the light source module is arranged on the upper base 21, light is emitted from the bottom base of the trapezoid so as to facilitate the diffusion of the light emitted by the light source module, that is, to enlarge the irradiation range of the LED strip lighting. Since the house 20 has the trapezoid structure, the link mechanism 30 and the clamping mechanism 40 can be disposed on the gap between the house 20 and the installation frame 10 so as to make the whole lamp compact structure and reduce costs. For beauty, the length of the bottom base of the house 20 is equal to the distance between the first and second free edge 11, 12 of the installation frame 10.

In one LED strip lighting, it may have one or more link mechanisms 30. The number of the link mechanisms 30 in the LED strip lighting are depend primarily on an axial length of the LED strip lamp and an axial length of the link mechanism 30. In the present embodiment, the axial length of the LED strip lighting is 1.5 meters and the LED strip lighting includes two link mechanisms 30 which are respectively mounted near two ends of the installation frame 10. The two line mechanisms 30 are disposed in one of two jointing edges which are formed by the first side wall 22 and the first free edge 11. Each of the line mechanisms 30 includes a first link 31 disposed on the first free edge 11 of the installation frame 10, a second link 32 disposed on the upper base 21 of the house 20, a third link 33 rotatably connected between the first and second links 31, 32, and two bearings 34. One of the two bearings 34 is configured for connecting the first link 31 and the second link 32, the other is used to connect the second link 32 and the third link 33. When the third link 33 is rotated around the bearing 34, the house 20 can be turned over with the third link 33. In order that the direction of the pulling force, which is applied to the third link 33, is aligned with the direction of the gravity received by the house 20, the first and second and third links 31, 32, 33 are perpendicular to each other in the cross section perpendicular to the axial direction of the house 20 when the house 20 has been installed. Since the first and second links 31, 32 are respectively fixed in the installation frame 10 and the house 20 and the direction of the pulling force, which is applied to the third link 33, is aligned with the direction of the gravity received by the house 20, the first and second links 31, 32 are horizontal when the house 20 has been installed.

The number of the clamping mechanisms 40 coincide with that of the link mechanism 30, and the clamping mechanism 40 is disposed opposite to the link mechanism 30. Therefore, in the present embodiment, the LED strip lighting includes two clamping mechanisms 40. The clamping mechanisms 40 are disposed the other jointing edge which is formed by the second side wall 23 and the second free edge 12. Each of the clamping mechanisms 40 includes a catch head 41 disposed on the installation frame 10, and a resilient lock 42 disposed in the house 20 and coupled to the catch head 41. One end of the catch head 41 is fixed the second free edge 12 of the installation frame 10, and the other extends from the second free edge 12. One end of the resilient lock 42 is fixed on the house 20 and the other is free so as to the free end of the resilient lock 42 have resilience. The free end of the resilient lock 42 has a V-shaped structure and the V-shaped free end thereof abuts against the catch head 41 when the house 20 is received into the installation frame 10. It can be understood that the structure of the clamping mechanism 40 may be of a variety of styles as long as one side of the house 20 can be clamped into the installation frame 10 and is easy to be disassembled therefrom. The link mechanism 30 and the clamping mechanism 40 are located on the opposite side of the house 20. Therefore, when the resilient lock 42 is coupled into the catch head 41, the house 20 has been received into the installation frame 10, and the first and second and third links 31, 32, 33 are perpendicular to each other. Since the direction of the pulling force, which is applied to the third link 33, is aligned with the direction of the gravity received by the house 20, the first, second and third links 31, 32, 33 form an unstable balance. However, the third link 33 can be held in its vertical state due to the ejection action of the clamping mechanism 40 to form a stable balance state so as to prevent the house 20 from rotating around the two bearings 34. As a result, the positional relationship between the first, second and third links 31, 32, 33 in the vertical state is maintained and the house 20 can be fixed into the installation frame 10 so as to achieve the purpose of completing the installation of the house 20 and the installation frame 10.

When need to disassemble, one side of the house 20 in which the clamping mechanism 40 is disposed may be raised by means of a tool, such as straight screwdriver, or the like, so that the resilient lock 42 is disengaged from the catch head 41. And the house 20 is turn down around the bear 34 under the action of gravity, thereby removing the house 20 from the installation frame 10.

As described above, as the flipping installation device 100 for LED strip lighting has the link mechanism 30 and the clamping mechanism 40, the installation frame 10 can be firstly fixed into an installation surface, such as the ceiling, or the like, and then, the house 20 is mounted into the installation frame 10. Since the installation frame 10 can be embedded into the ceiling, the house 20 also can be embedded into the ceiling so that the light emitting surface of the house 20 can be flush with the ceiling. As a result, the ceiling having the LED strip lighting has larger distance from the ground and more beautiful.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A flipping installation device for LED strip lighting, comprising:

an installation frame comprising a square slot;

a house received in the installation frame;

at least one link mechanism disposed in one of two jointing edges of the installation frame and the house, each of the at least one link mechanism comprising a first link mounted on the installation frame, a second link disposed on the house, and a third link rotatably connected between the first and second links, the first and second and third links being perpendicular to each other in a cross section perpendicular to an axial direction of the house when the house has been installed into the installation frame; and at least one clamping mechanism disposed in the other jointing edge of the installation frame and the house, each of the at least one clamping mechanism comprising a catch head disposed on the installation frame, and a resilient lock disposed on the house and coupled to the catch head, the link mechanism and the clamping mechanism being located on the opposite side of the house, wherein two stop bars are respectively provided on two free edges of the installation frame, the two stop bars are configured for limiting the depth of the house in the installation frame when the house is rotated into the square slot of the installation frame.

2. The flipping installation device for LED strip lighting as claimed in claim 1, wherein the house is a strip-typed structure and has a trapezoidal frame on the cross section perpendicular to the axial direction of the house.

3. The flipping installation device for LED strip lighting as claimed in claim 2, wherein the link mechanism and the clamping mechanism are disposed on the gap between the house and the installation frame.

4. The flipping installation device for LED strip lighting as claimed in claim 1, wherein one end of the resilient lock is fixed on the house, and the other is a free end.

5. The flipping installation device for LED strip lighting as claimed in claim 4, wherein the free end has a V-shaped structure and abuts against the catch head when the house is received into the installation frame.

6. The flipping installation device for LED strip lighting as claimed in claim 1, wherein the link mechanism further comprises two bearings, one of the two bearings is used to join the first link and the second link, the other is configured to join the second link and the third link.

7. The flipping installation device for LED strip lighting as claimed in claim 1, wherein the positional relationship between the first, second and third links in the vertical state is maintained when the house can be fixed into the installation frame.

8. The flipping installation device for LED strip lighting as claimed in claim 1, wherein the direction of the pulling force, which is applied to the third link, is aligned with the direction of the gravity received by the house.

* * * * *